US005940913A

United States Patent [19]

Horowitz

[11] Patent Number: 5,940,913

[45] Date of Patent: Aug. 24, 1999

[54] ADJUSTABLE BODY SUPPORT WITH IMPROVED NECK AND HEAD SUPPORT

[76] Inventor: Lawrence Fraser Horowitz, 618 Reyes Dr., Walnut, Calif. 91789

[21] Appl. No.: 09/134,994

[22] Filed: Aug. 17, 1998

[51] Int. Cl.[6] ..... A47G 9/00

[52] U.S. Cl. ..... 5/640; 5/636; 5/722

[58] Field of Search ..... 5/636, 637, 640, 5/644, 631, 632, 722, 727

[56] References Cited

U.S. PATENT DOCUMENTS

| | | | |
|---|---|---|---|
| 4,810,034 | 3/1989 | Beier | 297/284 |
| 4,829,614 | 5/1989 | Harper | 5/636 |
| 4,916,765 | 4/1990 | Castronovo | 5/636 |
| 4,965,886 | 10/1990 | Sarkozi | 5/640 |
| 5,014,377 | 5/1991 | Dixon | 5/636 |
| 5,020,174 | 6/1991 | Sarkozi | 5/640 |
| 5,123,132 | 6/1992 | Dixon | 5/636 |
| 5,553,218 | 9/1996 | Fahy | 5/636 |
| 5,682,633 | 11/1997 | Davis | 5/636 |

*Primary Examiner*—Alex Grosz
*Attorney, Agent, or Firm*—Daniel S. Kirshner

[57] ABSTRACT

An adjustable foam pillow which allows the user to choose the degree of support provided to the user's head and neck regions. Two column or rod shaped lateral neck bolsters are formed from foam having elliptical cross sections. A central bolster is provided which is also formed from foam. The central bolster includes neck-bolster recesses along the front and back wherein said recesses are sized and configured to snugly retain the lateral neck bolsters. The neck-bolsters indentations include gear teeth receptacles and the neck bolsters include gear teeth which mesh with the gear receptacles. A user can reorient the neck bolsters relative to the central bolster by rotating the neck bolsters. The gear arrangement provides a method of registering the position of the bolsters without permanently affixing them. A stretch terry cloth pillow cover fits snugly around the entire pillow thereby holding the three separate components together.

8 Claims, 4 Drawing Sheets

ADJUSTABLE BODY SUPPORT WITH IMPROVED NECK AND HEAD SUPPORT

FIELD OF THE INVENTION

The present invention relates to a pillow. More particularly, the present invention relates to a foam pillow comprising three foam bolsters which is selectively adjustable to provide the desired degree of support to the head and neck regions of the user.

BACKGROUND OF THE INVENTION

In order to survive and to perform their daily activities safely and efficiently, human beings need to sleep. Most people utilize some type of pillow or body support to sleep more comfortably and to cushion their back and head. For many sleepers, conventional pillows or body supports do not provide adequate protection and support for the head and neck. As a result, countless people do not rest adequately thereby impairing their day to day activities. Worse, improper support for the head or back may lead to pain or injury, thereby resulting in down time from work, inability to perform day to day activities, and sometimes leading to surgery or other medical intervention.

Many prior attempts have been made to resolve some of the problems resulting from the lack of comfort provided by conventional pillows or body supports. Several of these attempts included the use of a resilient material such as foam. One example of such a prior art pillow is disclosed in U.S. Pat. No. 4,956,886 entitled Self Adjustable Neck Support Pillow which was issued to Sarkozi on Sep. 18, 1990. A disadvantage of such a pillow is that it does not allow the user to register the position of its components in the position of desired support.

It is therefore an objective of the present invention to provide a body support that allows the user to adjust the body support thereby providing the desired degree of support to the head and neck areas.

It is further an objective of the present invention to allow the user to register the amount of support provided by the body support without the permanently affixing the components to one another.

It is further an objective of the present invention to provide a body support that is inexpensive to purchase, easy to manufacture and requires little or no training to use.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

SUMMARY OF THE INVENTION

The present invention is an adjustable foam pillow which allows the user to choose the degree of support provided to the user's head and neck regions. Two column or rod shaped lateral neck bolsters are formed from foam and have elliptical cross sections. A central bolster is provided which is also formed from foam. The central bolster includes neck-bolster recesses along the front and back surfaces wherein said recesses are sized and configured to snugly retain the lateral neck bolsters. The neck-bolsters indentations include gear teeth receptacles and the neck bolsters include gear teeth which mesh with the gear receptacles. A user can reorient the neck bolsters relative to the central bolster by rotating the neck bolsters. In one orientation, the neck bolster extends above the top surface of the central bolster thereby elevating the user's neck relative to the head. In other orientations, the neck bolster may lie at the same height as the top surface of the central bolster or may lie below the top surface of the central bolster. The gear arrangement provides a method of registering the position of the bolsters without permanently affixing them. A stretch terry cloth pillow cover fits snugly around the entire pillow thereby holding the three separate components together.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Figure 1:
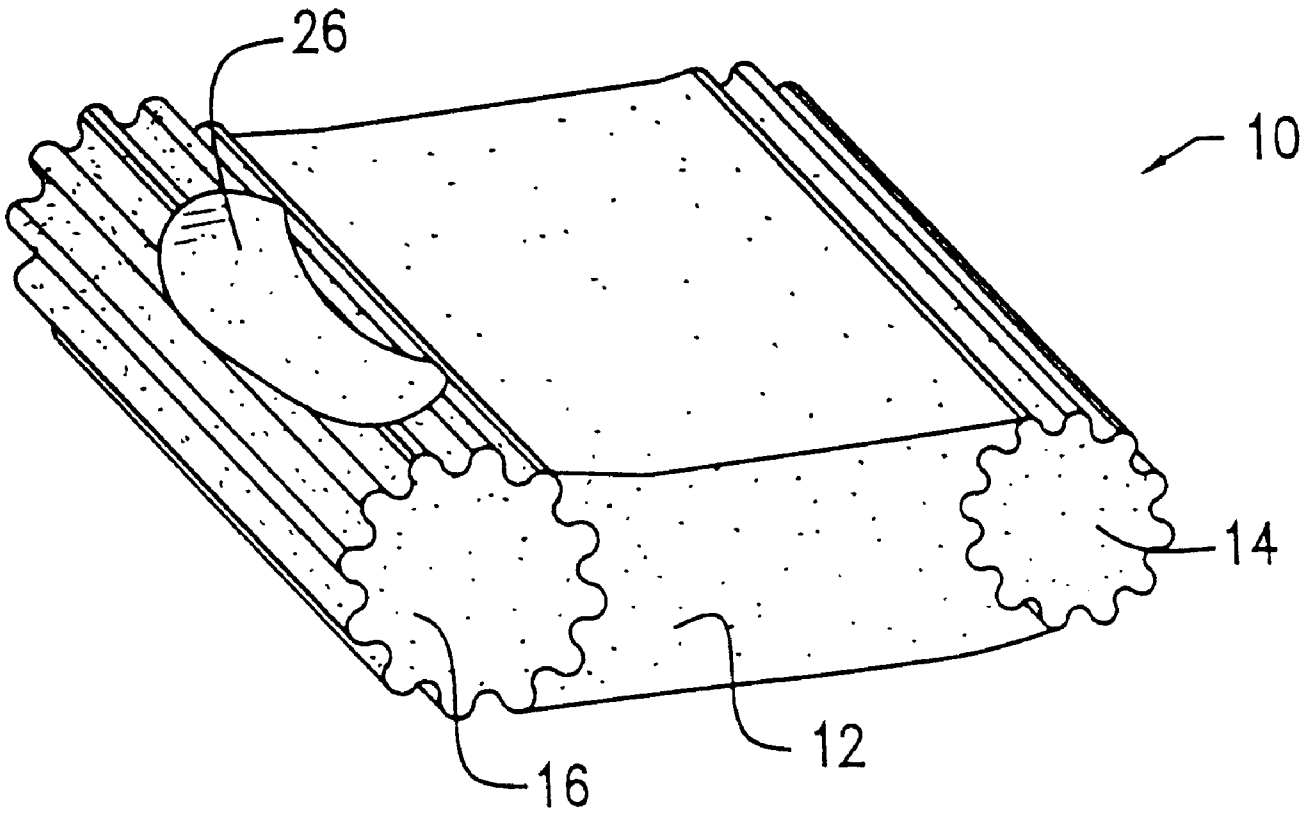
FIG. 1 is a top perspective view of the body support of the present invention.

Referring to FIG. 1, the present invention is a body support or pillow 10 formed from foam or other resilient material. The body support 10 of the present invention comprises three individual foam bolsters or cushions, a central bolster 12, a first lateral neck bolster 14 and a second lateral neck bolster 16 that fit together to form a unitary pillow. As is well known in the art of manufacturing foam products, the bolsters are formed from a bun of foam utilizing a contour cutter.

Figure 2:
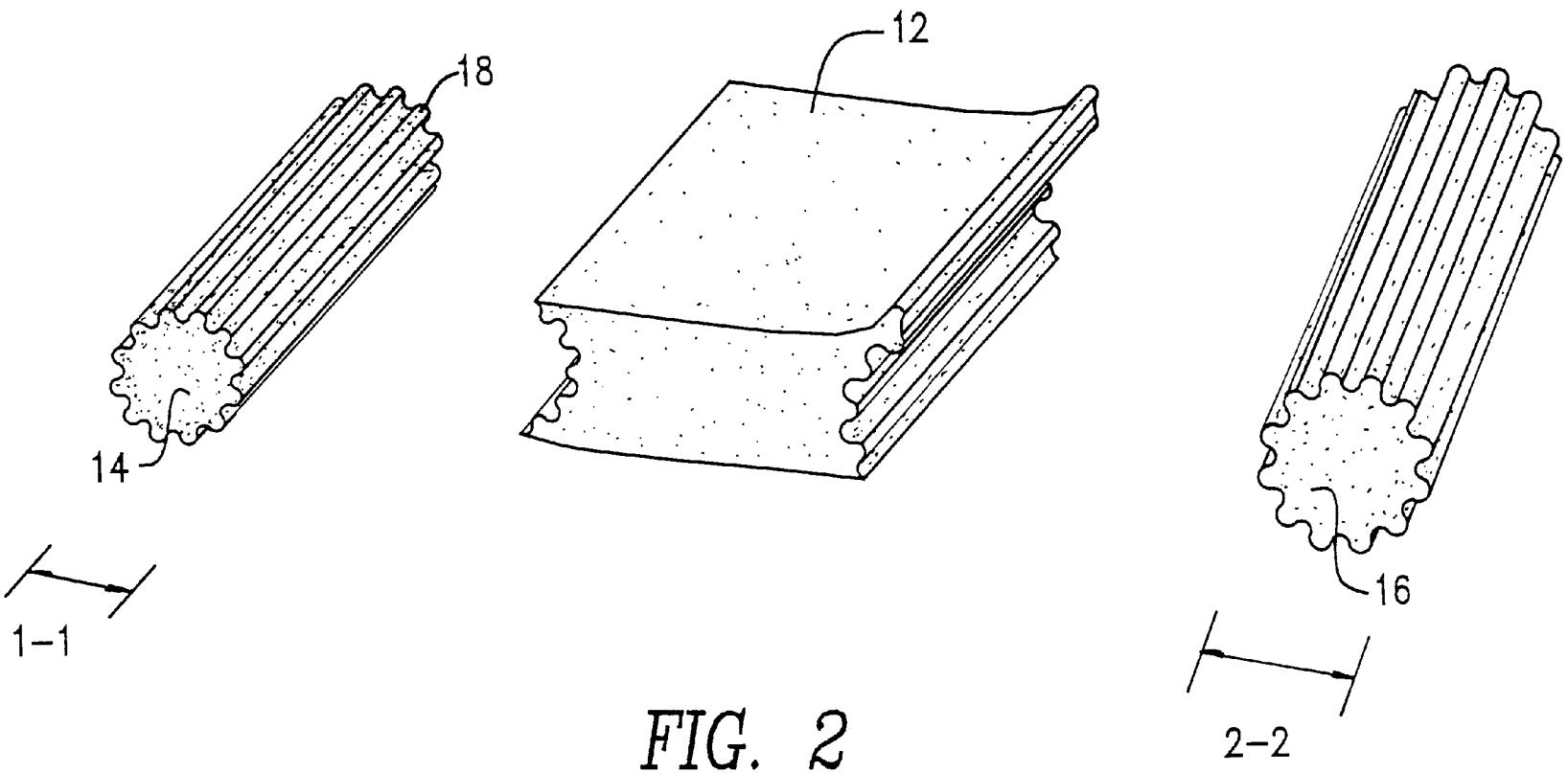
FIG. 2 is a top perspective view of the body support of the present invention partially exploded.
Figure 3:
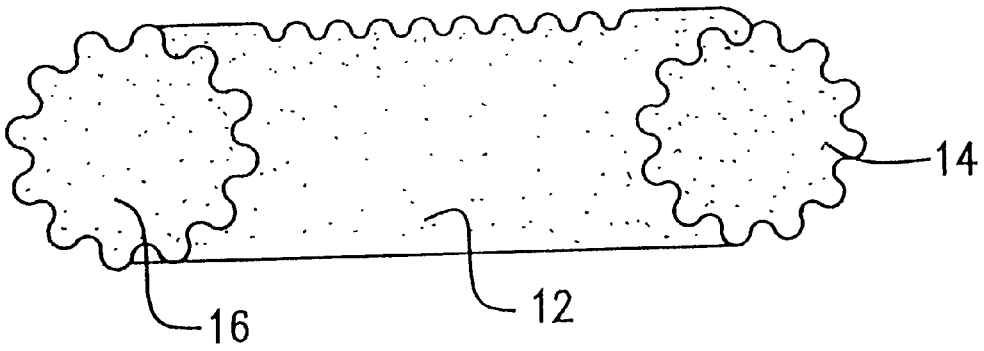
FIG. 3 is a side view of the body support of the present invention.

Referring to FIG. 2, two rod or column shaped lateral neck bolsters 14 and 16 having substantially equal length along the longitudinal axis are provided wherein said neck bolsters 14 and 16 have elliptical cross-sections. The neck bolsters 14 and 16 are formed from a resilient material wherein the preferred material is polyurethane foam. In the preferred embodiment, a plurality of gear teeth 18 are formed into the foam which run parallel to the longitudinal axis of the side bolsters. Furthermore, in the preferred embodiment, the distance 1—1 of the first neck bolster 14 is smaller than the distance 2—2 of the second neck bolster 16 wherein the distances 1—1 and 2—2 represent the maximum cross-sectional diameters of the neck bolsters 14 and 16 respectively. Furthermore, the first neck bolster 14 is more compressible than the second neck bolster. More specifically, as known in the art, the IFD firmness value represents the amount of displacement one can expect in a material when a weight acts upon it to compress the material. For the invention disclosed herein, the smaller neck bolster has a compressibility of 27 IFD whereas the larger neck bolster has a compressibility of 21 IFD.

Figure 4:
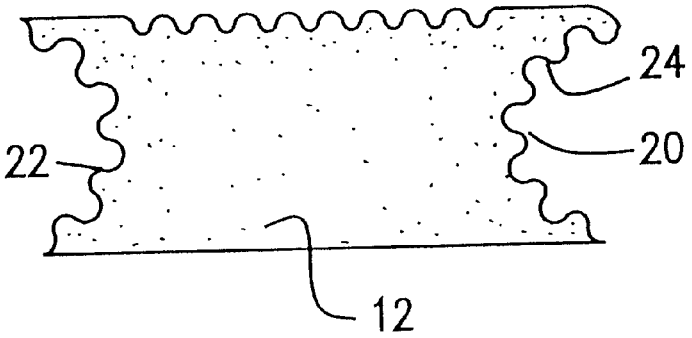
FIG. 4 is a side view of the central bolster of the present invention.

Referring to FIG. 4, the central bolster 12 is formed from foam or other resilient material wherein the preferred material for the central bolster is viscoelastic foam. The central bolster 12 is substantially rectangular having six surfaces designated the top, the bottom, the front, the back, and two sides. The bottom surface is substantially flat. A series of depressions and ridges are formed into the top surface of the central bolster 12. An arcuate neck-bolster recess 20 is formed into the front of the central bolster and a second arcuate neck-bolster recess 22 is formed into the back of the central bolster. The neck-bolster recesses 20 and 22 extend from one side to the other side of the central bolster and are sized and configured to receive and retain the lateral neck bolsters 14 and 16 snugly. In the preferred embodiment, gear teeth receptacles 24 which mate with the gear teeth 18 of the neck bolsters 14 and 16 are formed into the neck-bolster recesses 20 and 22. Referring again to FIG. 2, the height of the central bolster 12 is chosen so that it is greater than the dimension 1—1 of the smaller neck bolster, and smaller than the dimension 2—2 of the larger neck bolster.

The three foam bolsters are fitted together, i.e. the lateral neck bolsters 14 and 16 are fitted into the neck bolster recesses 20 and 22 of the central bolster thereby forming a unitary pillow. The neck bolsters 14 and 16 are held in place adjacent to the central bolster 12 by the gear teeth 18 which fit into and mesh with the gear teeth receptacles 24. The gear design of the bolsters provides a method of registering the position of the bolsters relative to one another without permanently affixing them.

An elastic pillow cover is provided (not depicted in the Figures) which is configured to retain the three-piece pillow of the present invention. The pillow cover is formed from terry cloth material and is sized and dimensioned so that it snugly fits around the three-piece pillow of the present invention thereby holding the three foam bolsters together. The pillow cover takes the shape of a standard pillow case, i.e. it a piece of cloth material that is doubled over and sewn along three of the four sides. The fourth side is left open to allow insertion of the foam pillow therethrough. Furthermore, it is contemplated that the pillow cover can be supplied in various colors in order that that the user may choose the color that most appropriately matches the decor of the room and furniture.

Figure 5:
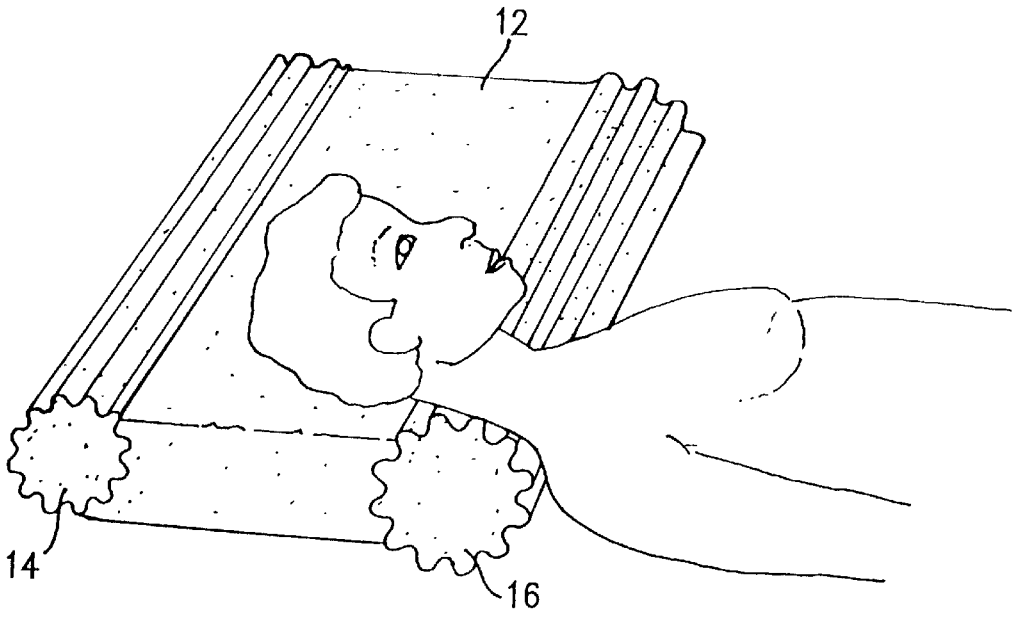
FIG. 5 is a top perspective view of the body support in of the present invention in conjunction with a user showing one lateral neck bolster oriented so that it extends above the top surface of the central bolster.
Figure 6:
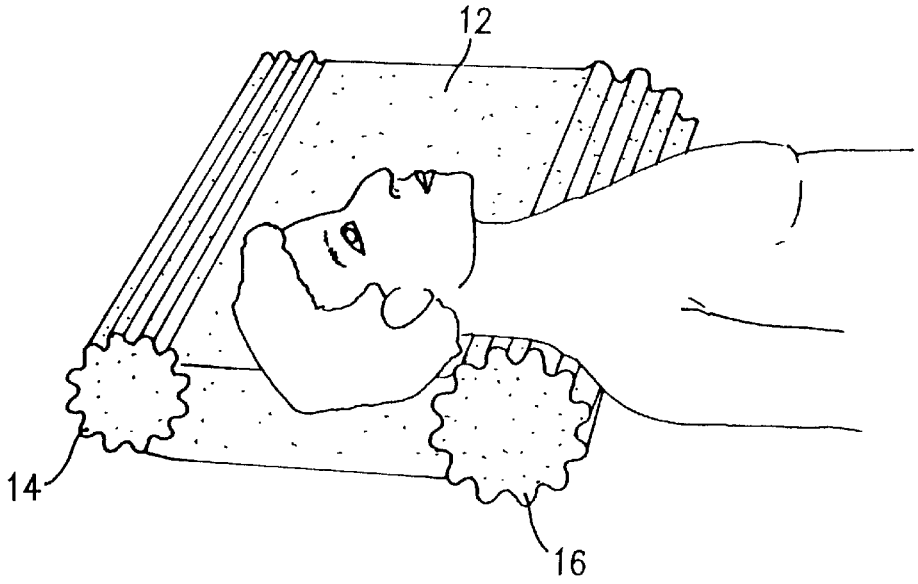
FIG. 6 is a top perspective view of the body support in of the present invention in conjunction with a user showing one lateral neck bolster oriented so that it lies even with the top surface of the central bolster.

Referring to FIGS. 5 and 6, a user may adjust the amount of support under the user's head and neck regions by selectively orienting one or both of the neck bolsters 14 and 16 with respect to the central bolster 12. Due to the elliptical cross section of the neck bolsters, the position of the neck bolster is adjustable relative to the central bolster 12. In one orientation seen in FIG. 5, the neck bolster 16 extends beyond the top surface of the central bolster 12 thereby elevating the neck of the user relative to the user's head. In another orientation seen in FIG. 6, the neck bolster 16 is oriented so that it lies even with the top surface of the central bolster. In yet a third orientation, the neck bolster is oriented so that it lies below the top surface of the central bolster.

In the embodiment depicted in FIG. 1, a cradle 26 is formed into one of the neck bolsters. The cradle 26 takes the form of an recess formed into the neck bolster and is shaped to cradle a typical human head. The user may rotate the neck bolster so that the cradle 26 is oriented to receive the user's head if desired, or may be rotated so as not to receive the user's head.

The preferred size of the present invention body support is the following: the height of the central bolster 12 is approximately 3.75 inches, the width of the central bolster 12 is approximately 12 inches, and the length of the central bolster 12 is approximately 20 inches. The length of the two neck bolsters 14 and 16 is also approximately 20 inches in order to correspond with the length of the central bolster 12 As seen in FIG. 2, the dimension 1—1 of the first neck bolster 14 is approximately 3 inches and as such is smaller than the height of the central bolster 12. The dimension 2—2 of the second neck bolster 16 is approximately 4 inches and as such is larger than the height of the central bolster.

What is claimed is:

1. An adjustable body support comprising a. at least one lateral bolster formed from a resilient material wherein said lateral bolster has an elliptical cross section;

b. a central bolster formed from a resilient material, said central bolster having a front surface, wherein said central bolster includes at least one lateral bolster recess sized and configured to receive said at least one lateral bolster;

whereby, a user can rotate said at least one lateral bolster relative to said central bolster thereby adjusting the degree of support afforded by said body support.

2. The body support of claim 1 wherein said body support includes a means for registering a predetermined position of said at least one lateral bolster relative to said central bolster.

3. The body support of claim 2 wherein said means for registering a predetermined position of said at least one lateral bolster relative to said central bolster comprises gear teeth receptacles on said lateral bolster recess and gear teeth on said lateral bolster of a size and shape configured to interlock with said gear receptacles thereby providing a method of registering the position the said at least one lateral bolster relative to said central bolster.

4. The body support of claim 1 wherein said resilient material is foam.

5. The body support of claim 1 wherein said at least one lateral bolster comprises a first lateral bolster and a second lateral bolster.

6. The body support of claim 5 wherein said first lateral bolster has a first cross-sectional dimension and said second lateral bolster has a second cross-sectional dimension, wherein said first cross-sectional dimension is different from said second cross-sectional dimension.

7. The body support of claim 1 further comprising a pillow cover.

8. A body support formed from a resilient material comprising:

a central bolster, said central bolster including a lateral bolster recess, and;

at least one lateral bolster having an elliptical cross section sized and configured to fit snugly into said lateral bolster recess of said central bolster, and a means for registering a predetermined position of said lateral bolster relative to said central bolster, whereby said lateral bolster is not permanently affixed to said central bolster whereby a user can rotate said at least one lateral bolster relative to said central bolster, thereby adjusting the degree of support afforded by said body support.

* * * * *